United States Patent [19]

Crowe

[11] 3,967,352

[45] July 6, 1976

[54] METHOD FOR MAKING A SCROLL TYPE HOUSING FOR A CENTRIFUGAL BLOWER

[75] Inventor: Kenneth Crowe, Simsbury, Conn.

[73] Assignee: Torin Corporation, Torrington, Conn.

[22] Filed: June 17, 1975

[21] Appl. No.: 587,644

[52] U.S. Cl. ..... 29/156.4 R; 29/453; 113/116 G; 417/363

[51] Int. Cl.[2] ..... B23P 15/00

[58] Field of Search..... 29/156.8 CF, 451, 156.4 R, 29/453; 113/116 G; 417/363

[56] References Cited

UNITED STATES PATENTS

| | | | |
|---|---|---|---|
| 1,526,917 | 2/1925 | Leland | 113/116 G UX |
| 1,926,947 | 9/1933 | Hull | 113/116 G UX |
| 1,931,151 | 10/1933 | Mueller | 113/116 G UX |
| 3,117,715 | 1/1964 | Bloomingdale | 417/363 |
| 3,401,870 | 9/1968 | Crowe | 417/363 X |
| 3,469,772 | 9/1969 | McDonald | 417/363 X |
| 3,653,116 | 4/1972 | Lov | 29/156.8 CF X |
| 3,803,690 | 4/1974 | Cann | 29/156.8 CF X |

*Primary Examiner*—Charlie T. Moon
*Attorney, Agent, or Firm*—McCormick, Paulding & Huber

[57] ABSTRACT

A method for making a scroll type housing for a centrifugal blower wherein a flat discharge plate is provided with a rectangular discharge opening and a pair of lugs are spaced from each of a first pair of opposing parallel edges of the opening. Narrow upstanding flanges along the edges are spaced slightly from the lugs and the second pair of opposing edges of the opening are each provided with a narrow elongated portion which is offset to a shallow depth in the direction of the flanges. A scroll member is provided in an elongated generally flat flexible sheet of material with a narrow end flange formed integrally along each end edge. The flanges project generally in the same direction and the member also has a reverse bend adjacent one end approximately in the form of a desired final configuration of a "cut-off" section of the housing. Three lanced openings are spaced apart along each side edge of the member. The scroll member is bent arcuately and the flanged ends thereof are brought toward each other and inserted through the opening in the discharge plate so as to reside respectively in the offset portions. Thereafter, a pair of similar flat side plates formed of sheet material in a scroll configuration and with linear edges at their discharge ends are assembled within the scroll. A first side plate has its linear edge entered between an adjacent flange and pair of lugs with the opposite end of the plate inclined within the scroll and the plate is then urged to a final upright position at the scroll edge. Three lugs on the plate enter the three openings in the scroll and the plate is thus held in assembled position. The second side plate is then assembled within the scroll in an identical manner.

9 Claims, 8 Drawing Figures

METHOD FOR MAKING A SCROLL TYPE HOUSING FOR A CENTRIFUGAL BLOWER

BACKGROUND OF THE INVENTION

Conventional methods of construction for scroll type housings include the welding of a plurality of parts, riveting, and rolling of edge portions after assembly etc. While generally satisfactory, such methods involve the use of separate and unnecessary parts, jigs, fixtures and it is usually required that the scroll member be rolled at least to its approximate final configuration prior to attachment to the other components.

SUMMARY OF THE INVENTION

It is the general object of the present invention to provide a method for making a scroll type housing wherein all attachment means are integrally formed on the parts of the housing thus wholly eliminating separate and external attachment means and effecting savings in jigs, fixtures and other auxiliary equipment, making possible complete assembly by one operator and thus eliminating intermediate material handling, and eliminating the pre-rolling of a scroll member into an approximate final configuration.

DESCRIPTION OF THE PREFERRED EMBODIMENTS

Figure 1:
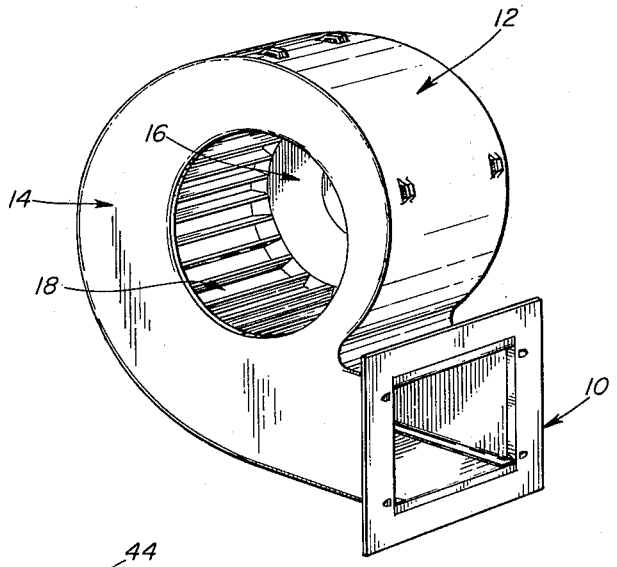
FIG. 1 is a perspective view of an assembled scroll type housing constructed in accordance with the method of the present invention, a centrifugal blower being illustrated in assembled position within the housing.
Figure 2:
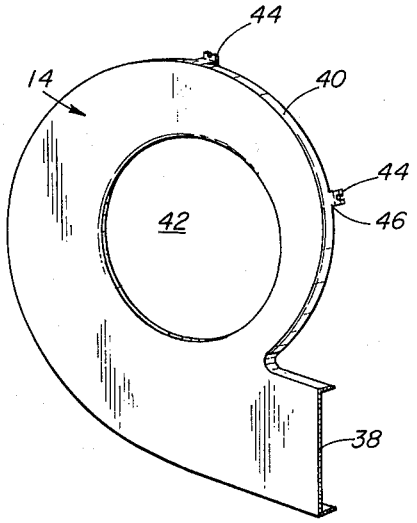
FIG. 2 is a perspective view of a side plate of a scroll type housing to be constructed in accordance with the method of the present invention.

Referring particularly to FIG. 1, it will be observed that a scroll type housing illustrated therein comprises a flat discharge plate 10, a scroll member 12, and similar or identical left and right hand side plates 14, 16. A centrifugal blower disposed within the housing is or may be of conventional construction.

Figure 3:
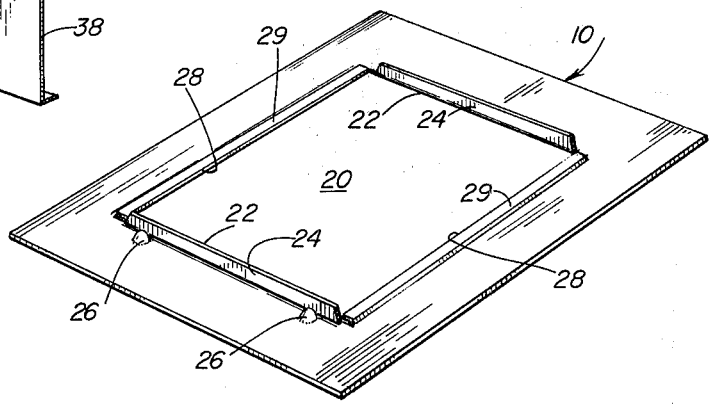
FIG. 3 is a perspective view of a discharge plate of a housing to be constructed in accordance with the present method.

The discharge plate 10, best illustrated in FIG. 3 is constructed of sheet material in flat form, preferably of metallic construction, and takes a generally rectangular plan form as shown with a rectangular discharge opening 20 therethrough.

In accordance with the invention, at least one integral side plate attachment means is formed adjacent each of a first pair of opposing parallel edges 22,22 of the discharge opening 20. As shown and as presently preferred, the said integral attachment means comprises a narrow upstanding flange 24 extending along each edge 22 and at least one lug 26 spaced from the flange and projecting from the plate in the same direction as the flange. Preferably two (2) lugs 26,26 are provided as illustrated and are spaced apart along the flange.

A second pair of edges 28,28 in opposing relationship across the opening 20, optionally have narrow elongated offset sections 29,29 which are of shallow depth, preferably slightly in excess of the thickness of a scroll member to be described hereinbelow.

Figure 4:
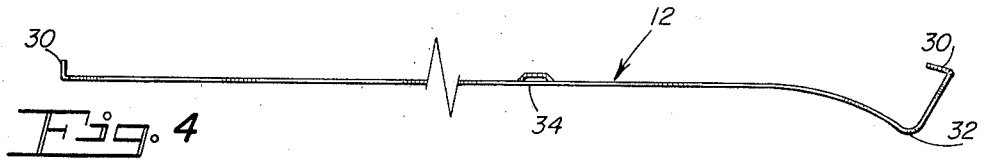
FIG. 4 is a side view of a scroll member designed for use with the present method and illustrated in a generally flat preform condition.

A scroll member 12, best illustrated in FIG. 4 is also formed of sheet material, preferably of metallic construction, and of a flexible characteristic so as to be readily bent in a gradual arcuate configuration as required for scroll formation. The width of the scroll member 12 is approximately equal to the length of the second pair of parallel opposing edges 28,28 at the discharge opening 20 and at each end of the member, an integral narrow end flange 30 is formed. The integral flanges 30,30 project generally at right angles from the scroll member and generally in the same direction. Adjacent its right hand end, as best shown in FIG. 4, the scroll member 12 also has a pre-formed cut-off section 32 which at least approximates the desired final configuration of the cut-off section of the scroll housing.

Integrally formed side plate attachment means on the scroll member 12 may vary as to characteristic and number but preferably at least one opening is provided adjacent each side edge of the scroll member and, more particularly, three (3) openings 34,34 are provided along each such edge. The openings 34,34 are approximately equally spaced apart along their respective edges and each opening is preferably formed by lancing a small portion in two small parallel slits so as to provide an outwardly covered opening. That is, small cover portions 36,36 are offset outwardly from the plane of the scroll member in the formation of the openings 34,34.

First and second or left and right hand side plates 14, 16 are formed of sheet material, preferably metallic, and each plate has a scroll-shaped periphery and a transverse linear edge 38 at its discharge end. Preferably, each side plate also has a narrow laterally extending flange 40 which terminates at said linear discharge edge. Air inlet openings such as 42 in the plates may also be flanged, single as well as double inlet blower constructions being contemplated within the scope of the invention and, further, formed in place inlet flanges or rings are within the inventive concept as well as separate after attached inlet rings.

In accordance with the invention each side plate is provided with at least one integral attachment means adapted to cooperate with the aforementioned scroll attachment means and at least one integral attachment means adapted to cooperate with the aforesaid discharge plate attachment means. As shown, each side plate is provided with three integral lugs spaced to cooperate with the three openings adjacent a side edge of the scroll member 12. Preferably, each lug 44 is formed integrally on a small flexible extension 46 of its adjacent flange 40. Thus, inward flexing of the lugs 44,44 is facilitated for purpose to be set forth hereinbelow.

Figure 5:
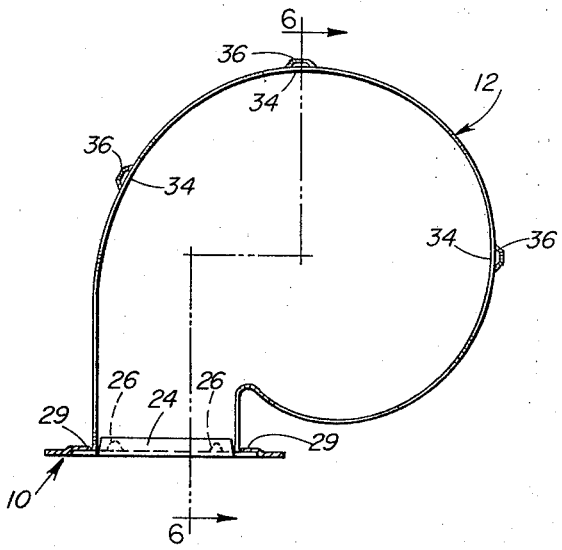
FIG. 5 is a side view of the scroll member and discharge plate in assembled positions.

In the practice of the method of the present invention, the parts are provided as hereinabove set forth. Thereafter, the scroll member 12 is gradually arcuately bent to bring the opposite ends thereof toward each other with the end flanges 30,30 facing outwardly and in opposite directions. Bending continues until the overall dimension between inner and outer edges of opposite flanges 30,30 is less than the distance between the second pair of opposing edges 28,28 of the opening 20 in the discharge plate 10. With the scroll member so held, its discharge end is entered through the discharge opening 20 with the end flanges 30,30 extending parallel with the edges 28,28 and the member is thereafter allowed to flex outwardly to position the flanges 30,30 in overlapping relationship with the discharge side of the plate 10. When the plate 10 is provided with the narrow offset portions 29,29, the flanges are entered therein so as to provide a flat surface on the discharge side of the plate 10. As will be apparent, the edges 28,28 of the opening 20 engage the scroll member 12 adjacent the flanges 30,30 and restrain the member against outward springing movement with the flanges serving to prevent withdrawal of the member from the discharge opening. Thus, a partial condition of assembly exists with the parts taking the relative positions shown in FIG. 5.

Figure 6:
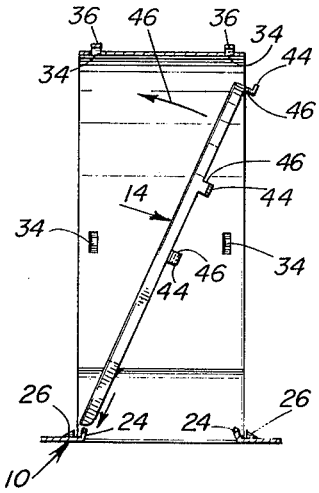
FIG. 6 is a sectional view of the scroll member and discharge plate and a first side plate in a position of partial assembly.
Figure 7:
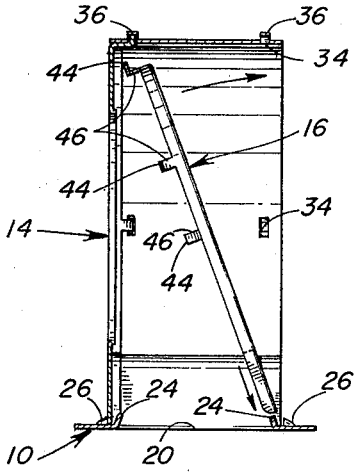
FIG. 7 is a sectional view similar to FIG. 6 but showing a first side plate fully assembled with the discharge plate and scroll member and a second side plate in a position of partial assembly.
Figure 8:
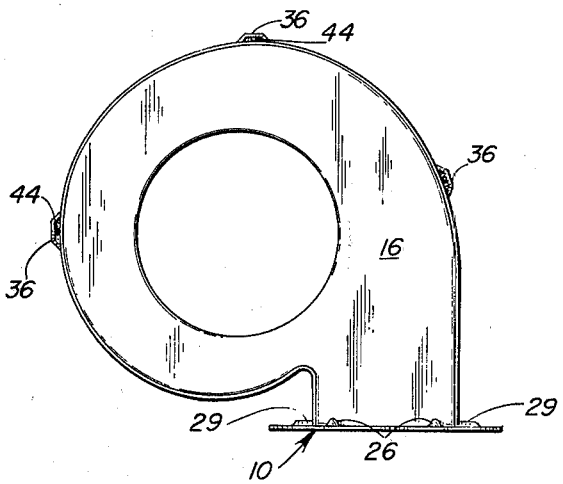
FIG. 8 is a side view of a fully assembled scroll housing.

In a next succeeding step of assembly, a side plate such as the left hand plate 14 shown in FIG. 6 is positioned within the scroll member 12 and the linear edge 38 thereof is entered between the lugs 26,26 and the small flange 24. The side plate may be conveniently held at an angle with respect to its final right angularly related position adjacent the discharge plate and the plate may thereafter be swung about its discharge end in a pivoting action as indicated by arrow 46 in FIG. 6. The small lugs 44,44 on the plate will thus be flexed inwardly and then spring outwardly into the scroll openings 34,34 whereby to complete assembly of the side plate within the scroll and discharge plate. In FIG. 7 the assembly of a second or right hand side plate 16 is illustrated and it will be apparent that the steps in assembly are identical with those set forth above for the left hand plate 14.

With the two side plates finally assembled within the scroll member and discharge plate a desirably rigid construction of a high degree of structural integrity is provided. Assembly operations may be accomplished by a single operator in a wholly manual procedure. There are no jigs or fixtures required, no separate attachment means such as rivets, screws, or welding are necessary and yet an end product is achieved, simple in construction, durable and dependable in use, and capable of assembly in an easy and convenient manner and at substantial economic advantage.

I claim:

1. A method for making a scroll type housing for a centrifugal blower, said method comprising the steps of:

a. providing a flat discharge plate constructed of sheet material with a rectangular discharge opening therethrough, b. forming at least one integral side plate attachment means adjacent each of a first pair of opposing parallel edges of the discharge opening, c. providing an elongated generally flat scroll member of flexible sheet material and of a width aproximately equal to the length of the second pair of parallel opposing edges of said discharge opening, said member having a narrow end flange formed integrally along each end edge, and said flanges projecting generally at right angles from the member and in the same direction, said member also having a generally reverse bend adjacent one end portion at least approximately in the form of a desired final configuration of a cut-off section of the scroll housing, and said member also having at least one integral side plate attachment means adjacent each side edge and between the ends thereof, d. gradually arcuately bending said scroll member to bring the opposite ends thereof toward each other with said end flanges facing outwardly and in opposite directions and until the overall dimension between inner and outer edges of opposite flanges is less than the distance between said second pair of opposing edges at said opening in said discharge plate, e. entering the flanged end of said scroll member in said discharge opening with said end flanges extending parallel with said second pair of opposed edges and thereafter allowing said member to flex outwardly whereby to assemble the scroll member and discharge plate with said second pair of opposing edges engaging and restraining the scroll member against outward springing movement, and with said end flanges flatly engaging the discharge plate on the side opposite the body of the scroll member to prevent withdrawal of the member from the discharge opening, f. providing a pair of similar flat side plates of sheet material with a scroll configuration at their periphery and a transverse linear edge at their discharge ends, each side plate having at least one integral attachment means adapted to cooperate with said scroll attachment means and at least one integral attachment means adapted to cooperate with said discharge plate attachment means, g. and respectively entering said plates in opposite side openings of the scroll member with each plate having its linear discharge edge in engagement with the discharge plate and each of plate having its scroll and discharge plate attachment means engaged respectively with a corresponding scroll and discharge plate attachment means.

2. A method for making a scroll type housing as set forth in claim 1 wherein each integral discharge plate attachment means on a side plate comprises a portion of the transverse linear edge of the plate, and wherein each integral side plate attachment means on the discharge plate comprises at least one lug which projects out of the plane of the discharge plate toward the body of the scroll member, said linear edges of the side plates being disposed inwardly of the lugs and in engagement therewith when the side plates are in assembled position within the scroll member.

3. A method for making a scroll type housing as set forth in claim 2 wherein each attachment means on the discharge plate comprises a pair of spaced apart similar lugs aligned along and spaced slightly from an adjacent one of said edges of said first pair of edges.

4. A method for making a scroll type housing as set forth in claim 2 wherein a narrow laterally projecting flange is formed integrally along each of said first pair of edges of said discharge opening, each of said flanges being spaced from the adjacent lug on said discharge plate, and said linear edge of an associated side plate being entered between the flange and lug during entry of the side plate to the scroll opening whereby to secure said edge of the plate against lateral displacement.

5. A method for making a scroll type housing as set forth in claim 2 wherein said cooperating side plate and scroll attachment means respectively comprise outwardly projecting lugs on the side plates and small openings in the scroll for receiving the same.

6. A method for making a scroll type housing as set forth in claim 5 wherein three spaced apart lugs are provided along the edge of each side plate, and wherein three cooperating openings are provided along each side edge of said scroll member.

7. A method for making a scroll type housing as set forth in claim 6 wherein each side plate has a narrow lateral flange extending along its edge but terminating at said linear edge, and wherein each lug is formed on a small flexible extension of said flange, each lug thus being inwardly flexed during entry of the side plate to the scroll opening, and the lug thereafter springing outwardly into its associated opening.

8. A method for making a scroll type housing as set forth in claim 7 wherein each opening in the scroll is formed by lancing a small portion whereby to provide an outwardly covered lug receiving opening after assembly.

9. A method for making a scroll type housing as set forth in claim 5 wherein said discharge plate includes a narrow elongated offset portion of shallow depth and extending along each said second pair of edges of said opening, said flanges on said scroll being disposed respectively in said offset portions during assembly to thus provide a flat surface throughout the discharge plate on the side thereof opposite the scroll.

* * * * *